US005476742A

United States Patent [19]

Tavernier et al.

[11] Patent Number: 5,476,742

[45] Date of Patent: Dec. 19, 1995

[54] TONER COMPOSITION SUITED FOR FIXING BY NON-CONTACT FUSING

[75] Inventors: Serge Tavernier, Lint; Werner Op de Beeck, Keerbergen; Jean-Pierre Ghekiere, Lint, all of Belgium

[73] Assignee: AGFA-Gevaert, N.V., Mortsel, Belgium

[21] Appl. No.: 369,520

[22] Filed: Jan. 5, 1995

Related U.S. Application Data

[62] Division of Ser. No. 160,738, Dec. 3, 1993, Pat. No. 5,395,726.

[30] Foreign Application Priority Data

Dec. 7, 1992 [EP] European Pat. Off. ..... 92203793

[51] Int. Cl.$^6$ ..... G03G 9/087

[52] U.S. Cl. ..... 430/109; 430/110; 430/111

[58] Field of Search ..... 430/109, 110, 430/111

[56] References Cited

U.S. PATENT DOCUMENTS

| | | | |
|---|---|---|---|
| 4,246,332 | 1/1981 | Tanaka et al. | 430/109 |
| 4,331,755 | 5/1982 | Gilliams et al. | 430/106 |
| 4,693,952 | 9/1987 | Koizumi et al. | 430/109 |
| 4,908,290 | 3/1990 | Watanabe et al. | 430/109 |
| 5,082,883 | 1/1992 | Alexandrovich et al. | 430/109 |
| 5,254,421 | 10/1993 | Coppens et al. | 430/49 |

*Primary Examiner*—Roland Martin
*Attorney, Agent, or Firm*—Breiner & Breiner

[57] ABSTRACT

A dry powder toner of which the particles are electrostatically or magnetically attractable and suited for development of electrostatic charge images or magnetic patterns and wherein the composition of said powder particles includes a resin binder comprising at least one resin A and at least one resin B, characterized in that:

(1) said resin(s) A and said resin(s) B each have a glass transition temperature (Tg) larger than 45° C., (2) the Tg of said resin(s) A is at least 2.5° C. lower than the Tg of said resin(s) B, (3) the melt viscosity (mvA) of said resin(s) A is at least 500 poise and the melt viscosity (mvB) of said resin(s) B is within the scope of the following equation:

$$(mvB)=F\times(mvA),$$

wherein F is an integer from 2 to 20, and with a maximum value of (mvB) not exceeding 15000 poise, and (4) the weight ratio of resin(s) A and resin(s) B in said powder particles is such that the deformability of the powder material as defined by test H herein is smaller than 15%.

12 Claims, No Drawings

TONER COMPOSITION SUITED FOR FIXING BY NON-CONTACT FUSING

This is a division of application Ser. No. 08/160,738 filed Dec. 3, 1993, now U.S. Pat. No. 5,395,726.

FIELD OF THE INVENTION

The present invention relates to a toner composition suited for development of electrostatic charge images or magnetic patterns.

BACKGROUND OF THE INVENTION

It is well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gets onto a dielectric substrate.

The obtained latent images are developed, i.e. converted into visible images by selectively depositing thereon light absorbing particles, called toner particles, which usually are triboelectrically charged.

In magnetography a latent magnetic image is formed in a magnetizable substrate by a patternwise modulated magnetic field. The magnetizable substrate must accept and hold the magnetic field pattern required for toner development which proceeds with magnetically attractable toner particles.

In toner development of latent electrostatic images two techniques have been applied: "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511.

The visible image of electrostatically or magnetically attracted toner particles is not permanent and has to be fixed by causing the toner particles to adhere to each other and the substrate by softening or fusing them followed by cooling. Normally fixing proceeds on more or less porous paper by causing or forcing the softened or fused toner mass to penetrate into the surface irregularities of the paper.

Dry-development toners essentially comprise a thermoplastic binder consisting of a thermoplastic resin or mixture of resins (ref. e.g. U.S. Pat. No. 4,271,249) including colouring matter, e.g. carbon black or finely dispersed dye pigments. The triboelectrically chargeability is defined by said substances and may be modified with a charge controlling agent.

There are different types of fusing processes used for fusing a toner powder image to its support. Some are based upon fixation primarily on fusing by heat, others are based on softening by solvent vapours, or by the application of cold flow at high pressure in ambient conditions of temperature. In the fusing processes based on heat, two major types should be considered, the "non-contact" fusing process and the "contact" fusing process. In the non-contact fusing process there is no direct contact of the toner image with a solid heating body. Such process includes: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp.

According to a particular embodiment of "non-contact" fusing the heat reaches the non-fixed toner image through its substrate by contacting the support at its side remote from the toner image with a hot body, e.g. hot metallic roller.

In an embodiment of common "contact" fusing the support carrying the non-fixed toner image is conveyed through the nip formed by a heating roller also called fuser roller and another roller backing the support and functioning as pressure exerting roller, called pressure roller. This roller may be heated to some extent so as to avoid strong loss of heat within the copying cycle.

The last mentioned fusing process has been employed widely in low-speed as well as high-speed fusing systems, since a remarkably high thermal efficiency is obtained because the surface of the heating roller is pressed against the toner image surface of the sheet to be fixed.

This fusing system has to be monitored carrefully in that when the fuser roller provides too much thermal energy to the toner and paper, the toner will melt to a point where its melt cohesion and melt viscosity is so low that "splitting" will occur, and some of the toner is transferred to the fuser roller wherefrom the toner stain may be transferred in a next copying cycle on a copy sheet whereon it may not deposit; such phenomenon is called "hot offset", and requires appropriate cleaning.

When on the other hand too little thermal energy is provided toner particles will adhere not Strong enough to the initially cold paper but can already stick sufficiently to the fuser roller wherefrom the "unfixed" partially fused toner particles will likewise be deposited onto the copy sheet of the next copying cycle, resulting in what is called "cold offset".

In order to avoid these phenomena the toner used in said fixing system operating with a hot pressure-fuser roller has to be composed such that said offset is minimized, but even then an external release agent, wetting the fuser roller has to be used. The application of an external liquid release agent represents an extra consumable and requires apparatus adaption making it more expensive. The release agent will inevitably also transfer to the copy paper and may produce prints having a fatty touch. The use of internal release agents, e.g. waxy polyolefine compounds, may after a certain period of use cause smearing to carrier particles and change triboelectric properties.

Moreover, for producing graphic art quality prints, e.g. of screened images, toner-contacting pressure fuser rollers will distort the dot structure of the screened images. Such will be particularly the case when the pressure-fuser roller has no perfect smooth structure and texturizes the obtained image.

The non-contact fusing process has not these drawbacks but requires for optimal fixing toners that have a visco-elastic behaviour such that the toner particles in the absence of pressure and by moderate heat fuse together and still form on cooling a toner mass of sufficient hardness to avoid smearing by contact in machine or manual use of the copies.

A toner with a too soft nature can give rise to problems as e.g. (i) smearing of the toner on the photoconductor layer, (ii) smearing of toner on the carrier particles, (iii) agglomeration of the toner with itself and the carrier particles when present whereby blocking and transport problems may arise and image resolution will be impaired.

When non-contact fusing systems are used in colour printing devices applying differently coloured toners deposited in succession it is important that the separate toner images become co-fused strongly enough with each other.

Such brings about that in non-contact fusing the melting point of the toner mass and consequently also of the thermoplastic binder(s) of the toner has to be much lower than of the toners applied in hot pressure-roller fixing.

Such will result in two conflicting requirements for a toner binder applied in non-contact fusing systems, particularly radiant systems, in that sufficiently low melt viscosity has to be combined with good toner hardness. For coloured toners the absorption of radiant energy and conversion in conduction heat will be dictated by the kind and amount of colorant and require an adapted melt viscosity that will be lower according as the absorption is less, which will be particularly low when a colourless toner is used that still may absorb invisible infrared radiation.

OBJECTS AND SUMMARY OF THE INVENTION

It is an object of the present invention to provide a dry toner composition suited for being fixed to a substrate by non-contact fusing and wherein the melt-viscosity of the toner composition is such that only moderate heat energy is needed to fuse and the hardness of the toner expressed as deformability is high enough to avoid smearing.

It is another object of the present invention to provide a method of fixing electrostatically or magnetically deposited toner particles to their substrate wherein toner particles are used having in their composition a blend or,resins whereby the toner obtains a sufficiently low melt-viscosity to cause effective co-fusing of the deposited toner particles and still has sufficient hardness to avoid smearing as defined above.

In accordance with the present invention a dry powder toner is provided the particles of which are electrostatically or magnetically attractable and suited for development of electrostatic charge images or magnetic patterns and wherein the composition of said powder particles includes a resin binder comprising at least one resin A and at least one resin B, characterized in that :

(1) said resin(s) A and said resin(s) B each have a glass transition temperature (Tg) larger than 45° C., (2) the Tg of said resin(s) A is at least 2.5° C. lower than the Tg of said resin(s) B, (3) the melt viscosity (mvA) of said resin(s) A is at least 500 poise and the melt viscosity (mvB) of said resin(s) B is within the scope of the following equation:

$$(mvB)=F\times(mvA),$$

wherein F is an integer from 2 to 20, and with a maximum value of (mvB) not exceeding 15000 poise, and (4) the weight ratio of said resin(s) A and said resin(s) B in said powder particles is such that the deformability of the powder material as defined by test H herein is smaller than 15%.

The present invention includes further a method of fixing electrostatically or magnetically deposited dry powder particles of said powder toner on the substrate whereon they have been deposited or on a substrate, e.g. paper sheet, whereon they have been transferred, wherein said fixing proceeds by a non-contact heat fusing process, which means that heat is delivered to said particles through said substrate and/or by hot gases, and/or by radiant energy directed to said particles, which are also called developer particles.

DETAILED DESCRIPTION OF THE INVENTION

Said dry powder when being free from a colorant is a colourless toner which may find application in toner development to create after fixing a glossy appearance on an already existing visible toner image. For producing visible images the powder contains in the resinous binder a colorant which may be black or having a colour of the visible spectrum, not excluding however the presence of mixtures of colorants to produce black or a particular colour.

In a prefered embodiment the Tg of said resin(s) A is in the range of 50°–55° C. and the Tg of said resin(s) B is in the range of 60°–65° C.

Preferably applied polyester resins are linear polycondensation products of (i) difunctional organic acids, e.g. maleic acid, fumaric acid, terephthalic acid and isophthalic acid and (ii) difunctional alcohols such as ethylene glycol, triethylene glycol, an aromatic dihydroxy compound, preferably a bisphenol such as 2,2-bis( 4-hydroxyphenyl)-propane called "bisphenol A" or an alkoxylated bisphenol, e.g. propoxylated bisphenol examples of which are given in U.S. Pat. No. 4,331,755. For the preparation of suitable polyester resins reference is made to GB-P 1,373,220.

A suitable resin A is a linear polyester of fumeric acid and propoxylated bisphenol A, having a melt viscosity of 1800 poise and a Tg of about 50° C.

Particularly interesting linear polyesters are commercial products such as ATLAC T500 (ATLAC is a registered trade name of Atlas Chemical Industries Inc. Wilmington, Del. U.S.A.) and ATLAC T500 is a linear polyester of fumaric acid and propoxylated bisphenol A.

Further are mentioned linear polyesters of terephthalic acid and bisphenol A denoted hereinafter in Table 1 as Resin L1 and Resin L2. A suitable resin A is an expoxy resin which is a linear adduct of bis-phenol A and epichlorhydrin having a melt viscosity of 750 poise and a Tg of about 52° C.

Preferably applied epoxy resins are linear adducts of bisphenol compounds and epichlorhydrin as described e.g. by D. H. Solomon in the book "The Chemistry of Organic Film Formers"—John Wiley & Sons, Inc, New York (1967) p. 180–181, e.g. EPIKOTE 1004 (EPIKOTE is a registered trade mark of the Shell Chemical Co).

In an embodiment of the present invention said developer particles contain a blend of polyester resins or blend of epoxy resins or a blend of epoxy resin(s) and polyester resin(s) satisfying the properties defined under the above items (1) to (4).

The Tg value in °C., melt viscosity in poise (P) and deformability in % of said polyesters and epoxy resin is mentioned in the following Table 1.

TABLE 1

| Resin | Type | Tg °C. | Melt viscosity poise | Deformability % |
|---|---|---|---|---|
| ATLAC T500 | Al | 50.5 | 1800 | 22 |

TABLE 1-continued

| Resin | Type | Tg °C. | Melt viscosity poise | Deformability % |
|---|---|---|---|---|
| Resin L1 | B1 | 65 | 5500 | 0.5 |
| Resin L2 | B2 | 63 | 7000 | 0.3 |
| EPIKOTE 1004 | A2 | 52 | 750 | 24 |

In the preparation of coloured toner particles a resin blend as defined herein is mixed with colouring matter which may be dispersed in said blend or dissolved therein forming a solid solution.

In black-and-white copying the colorant is usually an inorganic pigment which is preferably carbon black, but is likewise e.g. black iron (III) oxide. Inorganic coloured pigments are e.g. copper (II) oxide and chromium (III) oxide powder, milori blue, ultramarine cobaltblue and barium permanganate.

Examples of carbon black are lamp black, channel black and furnace black e.g. SPEZIALSCHWARZ IV (trade name of Degussa Frankfurt /M—Germany) and VULCAN XC 72 and CABOT REGAL 400 (trade names of Cabot Corp. High Street 125, Boston, U.S.A.).

The characteristics of a preferred carbon black are listed in the following Table 2.

TABLE 2

| | |
|---|---|
| origin | furnace black |
| density | 1.8 g × $cm^{-3}$ |
| grain size before entering the toner | 25 nm |
| oil number (g of linseed oil adsorbed by 100 g of pigment | 70 |
| specific surface (sq.m per g) | 96 |
| volatile material (% by weight) | 2.5 |
| pH | 4.5 |
| colour | black |

In order to obtain toner particles having magnetic properties a magnetic or magnetizable material in finely divided state is added during the toner production.

Materials suitable for said use are e.g. magnetizable metals including iron, cobalt, nickel and various magnetizable oxides, e.g. heamatite ($Fe_2O_3$), magnetite ($Fe_3O_4$), $CrO_2$ and magnetic ferrites, e.g. these derived from zinc, cadmium, barium and manganese. Likewise may be used various magnetic alloys, e.g. permalloys and alloys of cobalt-phosphors, cobalt-nickel and the like or mixtures of these.

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York, U.S.A (1950).

Likewise may be used the dyestuffs described in the following published European patent applications (EP-A) 0 384 040, 0 393 252, 0 400 706, 0 384 990, and 0 394 563.

Examples of particularly suited organic dyes are listed according to their colour yellow, magenta or cyan and are identified by name and Colour Index number (C.I. number) in the following Table 3 which also refers to the manufacturer.

TABLE 3

| | Colour Index 1 and 2 | | Manufacturer |
|---|---|---|---|
| Yellow dye | | | |
| Permanent Yellow GR | PY 13 | 21100 | Hoechst AG |
| Permanent Yellow GG02 | PY 17 | 21105 | id |
| Novoperm Yellow FGL | PY 97 | 11767 | id |
| Permanent Yellow GGR | PY 106 | | id |
| Permanent Yellow GRY80 | PY 174 | | id |
| Sicoechtgelb D1155 | PY 185 | | BASF |
| Sicoechtgelb D135ODD | PY 13 | 21100 | id |
| Sicoechtgelb D1351 | PY 13 | 21100 | id |
| Sicoechtgelb D1355DD | PY 13 | 21100 | id |
| Magenta dye | | | |
| Permanent Rubin LGB | PR57:1 | 15850:1 | Hoechst AG |
| Hostaperm Pink E | PR122 | 73915 | id |
| Permanent Rubin E02 | PR122 | 73915 | id |
| Permanent Carmijn FBB02 | PR146 | 12433 | id |
| Lithol Rubin D4560 | PR57:1 | 15850:1 | BASF |
| Lithol Rubin D4580 | PR57:1 | 15850:1 | id |
| Lithol Rubin D4650 | PR57:1 | 15850:1 | id |
| Fanal Rosa D4830 | PR81 | 45160:1 | id |
| Cyan dye | | | |
| Hostaperm Blue B26B | PB15:3 | 74160 1 | Hoechst AG |
| Heliogen Blau D707ODD | PB15:3 | 74160 | BASF |
| Heliogen Blau D7072DD | PB15:3 | 74160 | BASF |
| Heliogen Blau D7084DD | PB15:3 | 74160 | id |
| Heliogen Blau D7086DD | PB15:3 | 74160 | id |

In order to obtain toner particles with sufficient optical density in the spectral absorption region of the colorant, the colorant is preferably present therein in an amount of at least 1% by weight with respect to the total toner composition, more preferably in an amount of 1 to 10% by weight.

Black toner particles according to the present invention for use in fixing by infrared radiant units have preferably a melt viscosity of the powder mass (as defined by test V herein) lower than 7000 P. Colourless toners for use in said fixing unit have preferably a melt viscosity not exceeding 2500 P, and colour toners depending on their radiation absorption have preferably a melt viscosity between 7000 and 3000 P.

In order to modify or improve the triboelectric chargeability in either negative or positive direction the toner particles may contain (a) charge control agent(s). For example, in published German patent application (DE-OS) 3,022,333 charge control agents for yielding negatively chargeable toners are described. In DE-OS 2,362,410 and U.S. Pat. No. 4,263,389 and 4,264,702 charge control agents for positive chargeability are described. Very useful charge controlling agents for providing a net positive charge to the toner particles are described in U.S. Pat. No. 4,525,445, more particularly BONTRON NO4 (trade name of Oriental Chemical Industries—Japan) being a nigrosine dye base neutralized with acid to form a nigrosine salt, which is used e.g. in an amount up to 5% by weight with respect to the toner particle composition. A charge control agent suitable for use in colourless or coloured toner particles is zinc benzoate and reference therefor is made to published European patent Application 0 463 876 decribing zinc benzoate compounds as charge controlling agents. Such charge controlling agent may be present in an amount up to 5% by weight with respect to the toner particle composition.

In order to improve the flowability of the toner particles spacing particles may be incorporated therein. Said spacing particles are embedded in the surface of the toner particles or are protruding therefrom. These flow improving additives are preferably extremely finely divided inorganic or organic materials the primary (i.e. non-clustered) particle size of which is less than 50 nm. Widely used in this context arc, fumed inorganics of the metal oxide class, e.g. selected from the group consisting of silica ($SiO_2$), alumina ($Al_2O_3$), zirconium oxide and titanium dioxide or mixed oxides thereof which have a hydrophilic or hydrophobized surface.

Fumed metal oxides are prepared by high-temperature hydrolysis of the corresponding vaporizable chlorides according to the following reaction scheme illustrative for the preparation of fumed $Al_2O_3$:

$$4\ AlCl_3+6\ H_2+O_2 \rightarrow 2\ Al_2O_3+12\ HCl$$

The fumed metal oxide particles have a smooth, substantially spherical surface and before being incorporated in the toner mass are preferably coated with a hydrophobic layer, e.g. formed by alkylation or by treatment with organic fluorine compounds. Their specific surface area is:preferably in the range of 40 to 400 $m^2/g$.

In preferred embodiments the proportions for fumed metal oxides such as silica ($SiO_2$) and alumina ($Al_2O_3$) incorporated in the particle composition of the toner particles are in the range of 0.1 to 10% by weight.

Fumed silica particles are commercially available under the tradenames AEROSIL and CAB-O-Sil being trade names of Degussa, Franfurt/M Germany and Cabot Corp. Oxides Division, Boston, Mass., U.S.A. respectively. For example, AEROSIL R972 (tradename) is used which is a fumed hydrophobic silica having a specific surface area of 110 $m^2/g$. The specific surface area can be measured by a method described by Nelsen and Eggertsen in "Determination of Surface Area Adsorption measurements by continuous Flow Method", Analytical Chemistry, Vol. 30, No. 9 (1958) p. 1387–1390.

In addition to the fumed metal oxide, a metal soap e.g. zinc stearate may be present in the toner particle composition.

Instead of dispersing or dissolving (a) flow-improving additive(s) in the resin mass of the toner particle composition they may be mixed with the toner particles, i.e. are used in admixture with the bulk of toner particles. For that purpose zinc stearate has been described in the United Kingdom Patent Specification No. 1,379,252, wherein also reference is made to the use of fluor-containing polymer particles of sub-micron size as flow improving agents. Silica particles that have been made hydrophobic by treatment with organic fluorine compounds for use in combination with toner particles are described in published EP-A 467439.

The toner powder particles according to the present invention are prepared by mixing the above defined binder and ingredients in the melt phase, e.g. using a kneader. The kneaded mass has preferably a temperature in the range of 90° to 140° C., and more preferably in the range of 105° to 120° C. After cooling the solidified mass is crushed, e.g. in a hammer mill and the obtained coarse particles further broken e.g. by a jet mill to obtain sufficiently small particles from which a desired fraction can be separated by sieving, wind sifting, cyclone separation or other classifying technique. The actually used toner particles have preferably an average diameter between 3 and 20 μm determined versus their average volume, more preferably between 5 and 10 μm when measured with a COULTER COUNTER (registered trade mark) Model TA II particle size analyzer operating according to the principles of electrolyte displacement in narrow aperture and marketed by COULTER ELECTRONICS Corp. Northwell Drive, Luton, Bedfordshire, LC 33, UK. In said apparatus particles suspended in an electrolyte (e.g. aqueous sodium chloride) are forced through a small aperture, across which an electric current path has been established. The particles passing one-by-one each displace electrolyte in the aperture producing a pulse equal the displaced volume of electrolyte. Thus particle volume response is the basis for said measurement. The average diameter (size) of the toner particles derived from their average volume or weight is given by the instrument (see also ASTM Designation: F 577-83).

Suitable milling and air classification may be obtained when employing a combination apparatus such as the Alpine Fliessbeth-Gegenstrahlmühle (A.G.F.) type 100 as milling means and the Alpine Turboplex Windsichter (A.T.P.) type 50 G.C as air classification means, available from Alpine Process Technology, Ltd., Rivington Road, Whitehouse, Industrial Estate, Runcorn, Cheshire, UK. Another useful apparatus for said purpose is the Alpine Multiplex Zick-Zack Sichter also available from the last mentioned company.

To the obtained toner mass a flow improving agent is added in high speed stirrer, e.g. HENSCHEL FM4 of Thyssen Henschel, 3500 Kassel Germany.

The glass transition temperature (Tg) mentioned herein is determined according to ASTM Designation.: D 3418-82.

The melt viscosity and deformability measurements carried out on said resins and the final toner proceed by the following tests V and H respectively.

TEST V

For determining the melt viscosity of the selected sample a RHEOMETRICS dynamic rheometer, RVEM-200 (One Possumtown Road, Piscataway, N.J. 08854 USA) is used. The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians. Before recording the measurement signals which are expressed in poise (P), the sample is allowed to attain thermal equilibrium for 10 minutes.

TEST H

The deformability of the toner being a measure for the toner hardness is measured at 52.5° C. The following procedure is followed:

The toner material is compressed in a tablet with dimensions of 10 mm and height 10 mm at a pressure of 10 ton full-load for 30 seconds at 20° C. Then the obtained tablet after removal of said pressure is conditioned for 15 minutes at 52.5° C. Then the tablet is loaded with 40 kg-weight during 10 minutes.

The starting height (HS) and the final height (HF) of the tablet is measured and the deformability (D) is expressed as a percentage value by following equation $$D\ in\ \% = 100 \times (HS-HF)/HS$$

The powder toner particles according to the present invention may be used as mono-component developer, i.e. in the absense of carrier particles but are preferably used in a two-component system comprising carrier particles.

When used in admixture with carrier particles, 2 to 10% by weight of toner particles is present in the whole developer composition. Proper mixing with the carrier particles may be obtained in a tumble mixer.

Suitable carrier particles for use in cascade or magnetic brush development are described e.g. in United Kingdom Patent Specification 1,438,110. For magnetic brush development the carrier particles may be on the basis of ferromagnetic material e.g. steel, nickel, iron beads, ferrites and the like or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 μm and more preferably in the range of 30 to 100 μm.

In a particularly interesting embodiment iron carrier beads of a diameter in the range of 50 to 200 μm coated with a thin skin of iron oxide are used. Carrier particles with spherical shape can be prepared according to a process described in United Kingdom Patent Specification 1,174,571.

It has been established experimentally by us that a toner-deformability of no more than 5% allows agglomeration-free use of the toner according to the present invention at 4% by weight concentration in admixture with a ferrite carrier running in an electrophotographic copying apparatus equipped with a radiation fusing unit and magnetic brush development unit.

The present invention without limiting it thereto is illustrated by the following invention examples 1 to 5 the results of which are compared with the results of comparative (non-invention) examples 6 to 10.

INVENTION EXAMPLES 1 TO 5

The composition of the invention toners 1 to 5 is given in Table 4 below together with properties of the toners. The resins applied in said toners have been described with their properties in Table 1.

All toner ingredients are defined as parts by weight.

TABLE 4

| | Colourless toner | | | Blue Toner | Black Toner |
|---|---|---|---|---|---|
| Example | 1 | 2 | 3 | 4 | 5 |
| Resin type A1 | 80 | 80 | | 67 | 67 |
| Resin type A2 | | | 50 | | |
| Resin type B1 | 20 | | 50 | 33 | 33 |
| Resin type B2 | | 20 | | | |
| Carbon Black | | | | | 9 |
| Cu-phthalocyanine as blue colorant | | | | 9 | |
| Charging Agent | 2 | 2 | 2 | 2 | 2 |
| Properties of toner | | | | | |
| Deformability (%) | 1.4 | 8.4 | 4.9 | 4.9 | 2.9 |
| Melt visc. (poise) | 2200 | 2300 | 1500 | 4500 | 6200 |

The different toner compositions were prepared by mixing in the melt phase (at 120° C.) the ingredients as shown in Table 4.

After obtaining a homogeneous mixture, the paste-like mass was cooled down, crushed and further finely divided in a jet mill, whereupon it was classified to Obtain a toner fraction of mean diameter 8.5 μm derived from their average volume using the already mentioned COULTER COUNTER (registered trade mark) Model TA II particle size analyzer.

The melt viscosity and deformability of the thus obtained toner was then measured.

Ethoxylated amorphous silica (specific surface area 130 $m^2/g$) was added as flowing agent to the bulk of the toner particles such at a concentration of 0.5% by weight with respect to the total weight of the toner particles and thoroughly mixed therewith.

5 parts of the thus obtained toner powder was mixed with 100 parts of resin-coated ferrite carrier particles with average particle size by volume of 55 μm.

The thus prepared two-component developer was used in an electrophotographic copying apparatus equipped with magnetic brush development unit and running several copying cycles.

The electrostatically deposited toner was transferred from the photoconductive recording member onto a receiving paper which was led under an infrared radiator provided with reflector. At the rear side and in contact with the copying paper a heating plate kept at 125° C. was arranged. The infrared radiation source (power 550 watt, colour temperature about 2600K) was located at a distance of 10 cm from the toner image passing by at a speed of 5 cm/s.

After more than 100,000 copying cycles no degradation in image quality could be detected. No toner smearing occured on either carrier particles or photoconductive recording member and no agglomeration of toner particles in toner-carrier mixture could be found. The fixing of said transferred toner particles to paper by said fusing operation was strong enough to show no smearing by touching and rubbing by hand.

It is proved by the results obtained with the toners of the invention Examples 1 to 5 that the toner binder formed from the mixed resins A & B having the properties defined, gives the required hardness and melt viscosity properties desired for an improved fixing in non-contacting fusing particularly when operating with infra-red radiation fusing apparatus.

COMPARATIVE (non-invention) EXAMPLES 6 TO 10

The composition of the non-invention toners 6 to 10 having an average particle diameter as for the invention toners of the Examples 1 to 5 is given in Table 5 below together with properties of the toners in order to show that deviation from the selected properties and/or ratios gives inferior development results.

The resins A1, A2 and B1 have been described with their properties in Table 1. Resin C (used for comparison purposes) is a polycondensation product of bis-phenol A and dimethylterephthalic acid marketed under the tradename NCP002 by Nippon Carbide. Industries Co., Inc. New Tokyo Bldg. No. 3-1 Marunouchi, Chiyoda Tokyo , Japan. Resin C has a Tg of 72° C., melt viscosity of 20,500 poise and deformation of 0.5%.

All toner ingredients are defined as parts by weight.

TABLE 5

| | Black | Black | Black | Colourless toner | |
|---|---|---|---|---|---|
| Example | 6 | 7 | 8 | 9 | 10 |
| Resin A1 | 100 | 50 | | | 80 |
| Resin A2 | | 50 | | | |
| Resin B1 | | | 100 | | |
| Resin C | | | | 100 | 20 |
| Carbon Black | 9 | 9 | 9 | | |
| Charging Agent | 2 | 2 | 2 | 2 | 2 |
| Properties of toner | | | | | |
| Deformability (%) | 23 | 24.6 | 1.5 | 0.5 | 12 |
| Melt visc.(poise) | 5060 | 1100 | 7500 | 20500 | 3400 |

The toners of the non-invention Examples 6 and 7 were subject as for the invention toners 1–5 to a test in an electrophotographic apparatus and fixing unit and Showed a degradation in image quality, smearing, and toner agglomeration after the same number of copying cycles.

The toner of non-invention Example 8 was subjected as for the invention toners 1–5 to a test in an electrophotographic apparatus and fixing unit and showed a less good fixing quality under said circumstances of applied radiation power.

The toners of the non-invention Examples 9 and 10 showed no toner agglomeration but poor fusing quality.

We claim:

1. A dry powder toner of which the particles are electrostatically or magnetically attractable and suited for development of electrostatic charge images or magnetic patterns and wherein the composition of said powder particles includes a resin binder comprising at least one polyester resin A and at least one polyester resin B, wherein:

(1) said polyester resin(s) A and said polyester resin(s) B each have a glass transition temperature (Tg) larger than 45° C., (2) the Tg of said polyester resin(s) A is at least 2.5° C. lower than the Tg of said polyester resin(s) B, (3) the melt viscosity (mvA) of said polyester resin(s) A is at least 500 poise and the melt viscosity (mvB) of said polyester resin(s) B is within the scope of the following equation:

$$(mvB)=F\times(mvA),$$

wherein F is an integer from 2 to 20, and with a maximum value of (mvB) not exceeding 15000 poise, and (4) the weight ration of said polyester resin(s) A and said polyester resin(s) B in said powder particles, is such that the deformability of the powder material as defined by test H herein is smaller than 15%.

2. Powder toner according to claim 1, wherein the Tg of said polyester resin(s) A is in the range of 50°–55° C. and the Tg of said polyester resin(s) B is in the range of 60°–65° C.

3. Powder toner according to claim 1, wherein said polyester resin A is a linear polyester of fumaric acid and propoxylated bisphenol A, having a melt viscosity of 1800 poise and a Tg of about 50° C.

4. Powder toner according to claim 1, wherein said polyester resin B is a linear polyester formed by the condensation of terephthalic acid and bisphenol A.

5. Powder toner according to claim 1, wherein said toner is suited for use in black and white copying and in which the toner particles include 1–15% by weight of carbon black, and said toner has a melt viscosity not exceeding 7000 poise.

6. Powder toner according to claim 1, wherein said toner is suited for use in colour copying and in which the toner particles include 1–15% by weight of a non black colourant, and said toner has a melt viscosity between 3000–7000 poise.

7. Powder toner according to claim 1, wherein said toner is colourless and in which the toner particles have a melt viscosity that does not exceed 2500 poise.

8. Powder toner according to claim 1, wherein the toner particles include up to 5% by weight of a charge controlling agent.

9. Powder toner according go claim 1, wherein the toner particles have an average diameter between 5 and 10 μm derived from their average volume determined according to the principles of electrolyt displacement in narrow aperture.

10. Powder toner according to claim 1, wherein said toner particles contain metal oxide particles optionally protruding from said toner particles, which metal oxide particles are selected from the group consisting of silica ($SiO_2$), alumina ($Al_2O_3$), zirconium oxide and titanium dioxide and mixed oxides thereof and have a primary particle size less than 50 nm and specific surface area in the range of 40 to 400 $m^2/g$.

11. Powder toner according to claims 1, wherein said toner particles are mixed with powder flow improving additives admixed to the bulk of toner particles.

12. Powder toner according to claim 1, wherein at least one of said polyester resins A and B is a linear polyester resin.

* * * * *